US011286682B2

(12) United States Patent
Dietrich

(10) Patent No.: US 11,286,682 B2
(45) Date of Patent: Mar. 29, 2022

(54) SWIMMING POOL VACUUM

(71) Applicant: Dan Dietrich, Delray Beach, FL (US)

(72) Inventor: Dan Dietrich, Delray Beach, FL (US)

(73) Assignee: HAMMERHEAD PATENTED PERFORMANCE, INC., Delray Beach, FL (US)

( * ) Notice: Subject to any disclaimer, the term of this patent is extended or adjusted under 35 U.S.C. 154(b) by 169 days.

(21) Appl. No.: 16/791,573

(22) Filed: Feb. 14, 2020

(65) Prior Publication Data

US 2020/0263444 A1 Aug. 20, 2020

Related U.S. Application Data

(60) Provisional application No. 62/805,537, filed on Feb. 14, 2019.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1604
See application file for complete search history.

(56) References Cited

U.S. PATENT DOCUMENTS

2014/0271175 A1* 9/2014 Kumar ..... E04H 4/1654 415/224.5

* cited by examiner

*Primary Examiner* — Michael D Jennings
(74) *Attorney, Agent, or Firm* — Malloy & Malloy, P.L.; Robert M. Downey

(57) ABSTRACT

A self-contained electrically powered and fully submersible swimming pool vacuum includes a vacuum head having a housing with an elongate vacuum mouth at a bottom end, a discharge opening at an opposite top end and a thrust channel extending therebetween. An electrically powered motor is supported within the thrust channel and drives a propeller to create a thrust through the housing from the vacuum mouth through the thrust channel and out from the discharge opening. A catch bag is removably secured to the top discharge opening for collecting debris sucked through the vacuum mouth. The vacuum includes an onboard power supply, a smart power switch for driving the motor at different speeds and for detecting and clearing motor jams, all contained within a watertight housing fixed to an outer side of the vacuum housing. In one embodiment, the onboard power supply is a lithium ion rechargeable battery.

4 Claims, 7 Drawing Sheets

SWIMMING POOL VACUUM

This non-provisional patent application is based on provisional patent application Ser. No. 62/805,537 filed on Feb. 14, 2019.

BACKGROUND OF THE INVENTION

Field of the Invention

The present invention relates to battery powered motorized swimming pool vacuums and, more particularly, to a submersible vacuum head having a housing with an electric motor and propeller mounted within the housing and an onboard power supply.

Discussion of the Related Art

Motorized swimming pool vacuum heads are well-known in the pool service industry. Typically, motorized vacuum heads include a housing having an open bottom end forming a suction mouth, an open top end and a motor and propeller mounted within the housing between the open bottom and top ends. A catch bag or net is attached over the open top end to catch dirt, leaves and other debris that is pulled through the suction mouth of the vacuum head as a result of thrust of the propeller that is driven by the motor. In most instances, the motor is powered by a 12 volt deep cycle high capacity marine battery that remains out of the pool. A power cord extends from the battery to the submersible vacuum head. Due to the considerable size and weight of the 12 volt marine battery, it is preferable to carry the battery on a wheeled cart which will also be used for transporting the vacuum head, power cord and other equipment to and from the swimming pool. The use of a 12 volt high capacity marine battery is desirable for use by pool service professionals who may have the need to clean as many as 20 residential swimming pools in a single day. However, there are instances where a lower duty vacuum head is beneficial, particularly for a homeowner or pool service professional, such as a supervisor, who may only have a need to clean 1-3 residential swimming pools during the course of a day. A lighter duty submersible pool vacuum head may avoid the need for a heavy 12 volt deep cycle marine battery, as well as a cart and other equipment. Moreover, the ability to carry the battery on the vacuum head would avoid the need for a power cord extending from the submersible vacuum head on the bottom of the pool to the 12 volt marine battery maintained out of the pool.

Accordingly, there remains a need for a lighter duty fully submersible and self-contained swimming pool vacuum head that includes an electrically powered motor and propeller and an onboard power supply for powering the motor. Moreover, there is a need for a fully submersible, self-contained battery powered swimming pool vacuum cleaning head that is easily transported from a vehicle or storage location and to a residential swimming pool without the need of a cart or other equipment, and further avoiding the need for a power cord between the battery power source and the motor in the vacuum head.

SUMMARY OF THE INVENTION

The present invention is directed to a self-contained battery powered and fully submersible swimming pool vacuum head having a housing with an elongate vacuum mouth at a bottom end, and a discharge opening at an opposite top end, and a thrust channel extending between the bottom and top ends. An electrically powered motor is supported within the thrust channel and drives a propeller to create a thrust through the housing from the vacuum mouth and through the thrust channel and out from the discharge opening. A catch bag is removably secured to the top discharge opening for collecting debris that is sucked through the vacuum mouth. The vacuum head includes an onboard power supply, a smart power switch for driving the motor at different speeds and in an auto reverse direction for detecting and clearing motor jams, all contained within a watertight housing that is fixed to an outer side of the vacuum head housing. In one embodiment, the onboard power supply is a lithium ion rechargeable battery.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
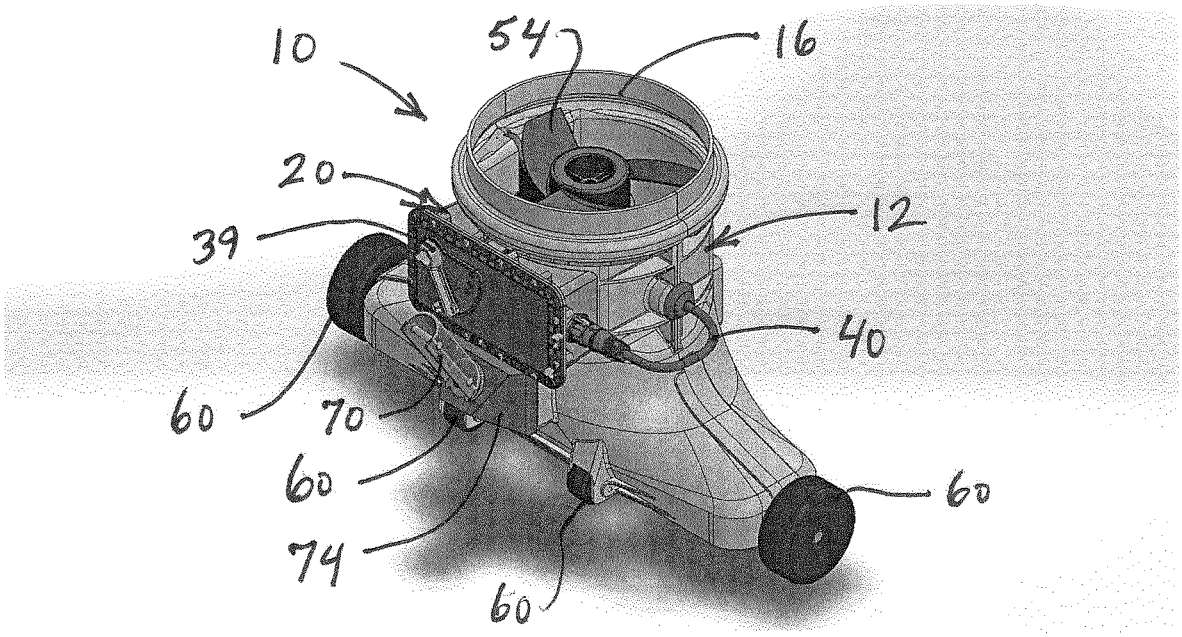
FIG. 1 is a side, rear perspective view of the swimming pool vacuum of the present invention.
Figure 2:
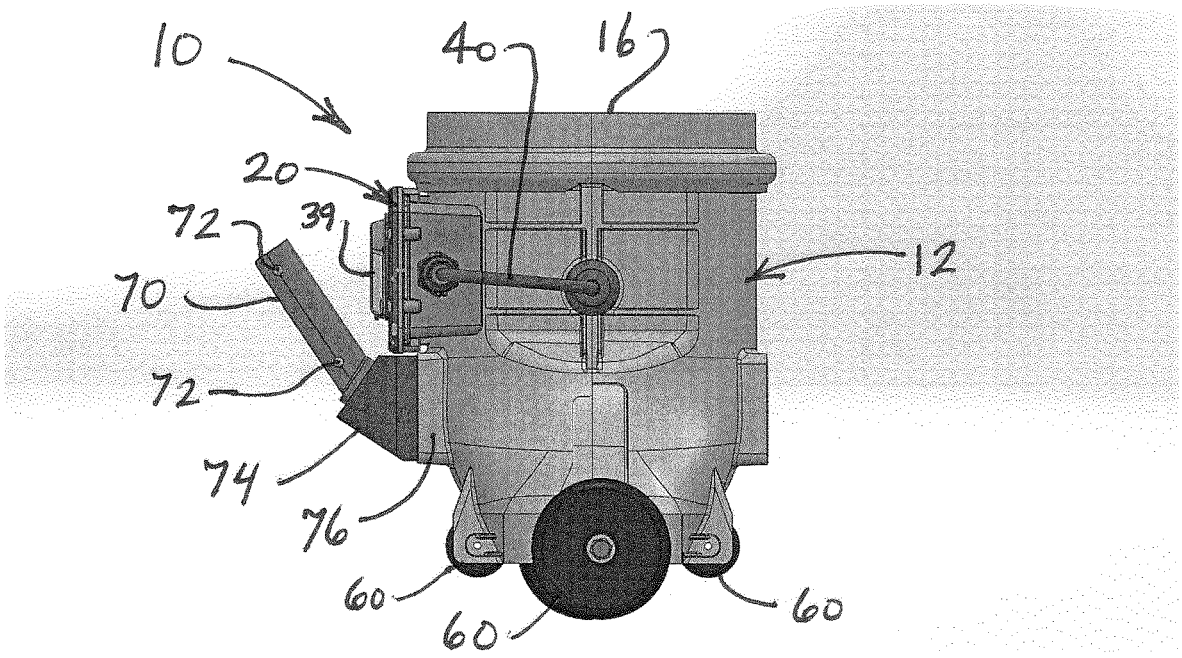
FIG. 2 is a side elevational view of the swimming pool vacuum.

Referring to the several views of the drawings, and initially FIG. 1, the self-contained, fully submersible swimming pool vacuum head of the present invention is shown and is generally indicated as 10. The vacuum head 10 includes a housing 12 having an elongate open bottom 14 and an opposite open top end 16. A watertight housing 20 for containing a rechargeable battery power supply 30 and a circuit board 34 including smart power switch 35 and other control circuitry is secured to the outer side of the housing. A watertight housing 20 includes at least one compartment 22 and a cover 24 that attaches to the watertight housing to maintain the compartment 22 watertight. A seal or gasket 26 may be used to provide a watertight attachment of the cover 24 to the housing 20 to maintain the compartment 22 watertight. A circuit board mounting plate 38 is provided between the battery power supply 30 and the circuit board 34 for securely mounting the circuit board 34 within the compartment 22. A watertight electrical connection 40 is made from the watertight circuitry housing and through the side of the vacuum head housing for connection to a motor 50 contained within an interior of the vacuum head housing. The motor 50 drives rotation of a motor shaft extending upwardly from the motor.

Figure 3:
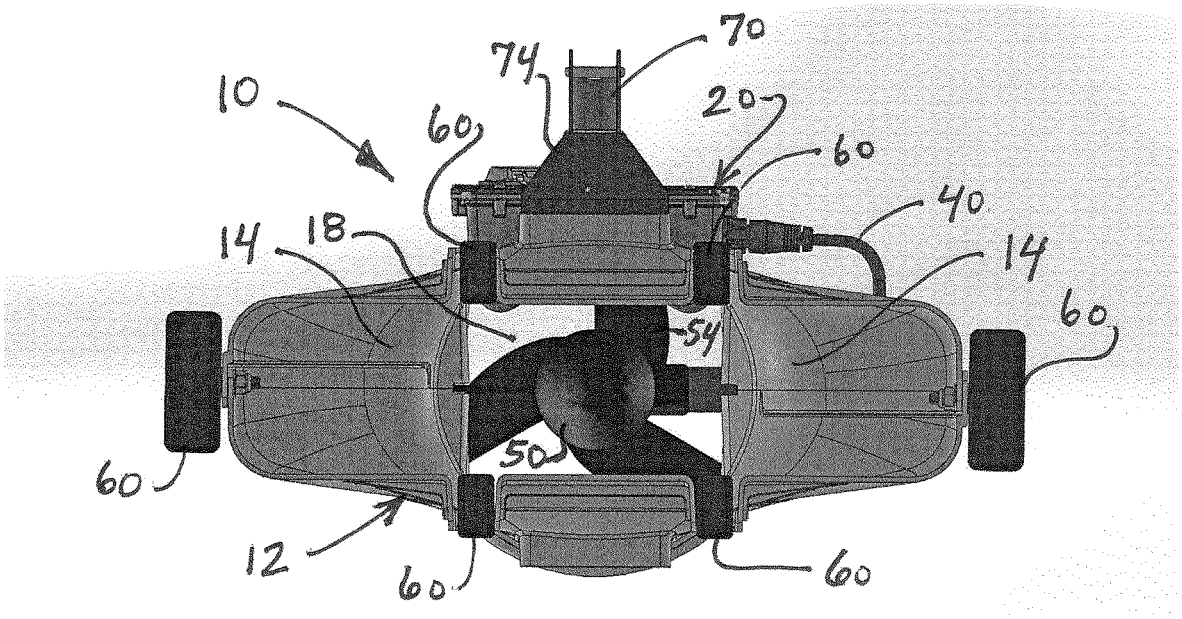
FIG. 3 is a bottom plan view showing the elongate vacuum mouth at a bottom of the vacuum head communicating with the thrust channel.
Figure 4:
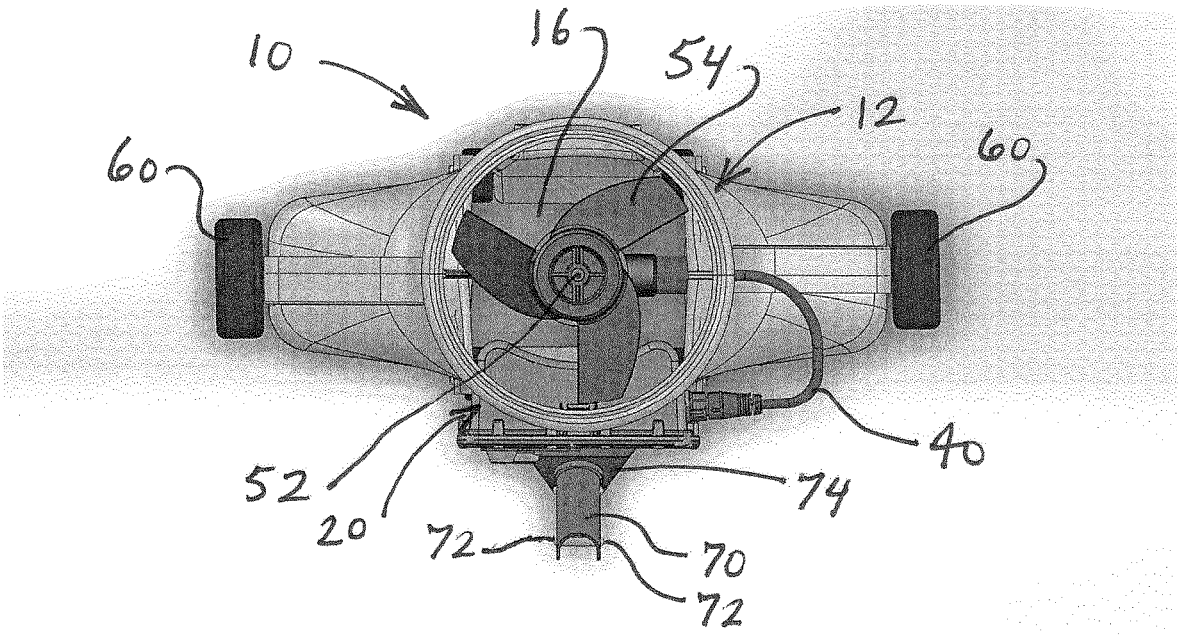
FIG. 4 is a top plan view showing a propeller secured to the shaft of the motor within the thrust channel of the vacuum head.
Figure 6:
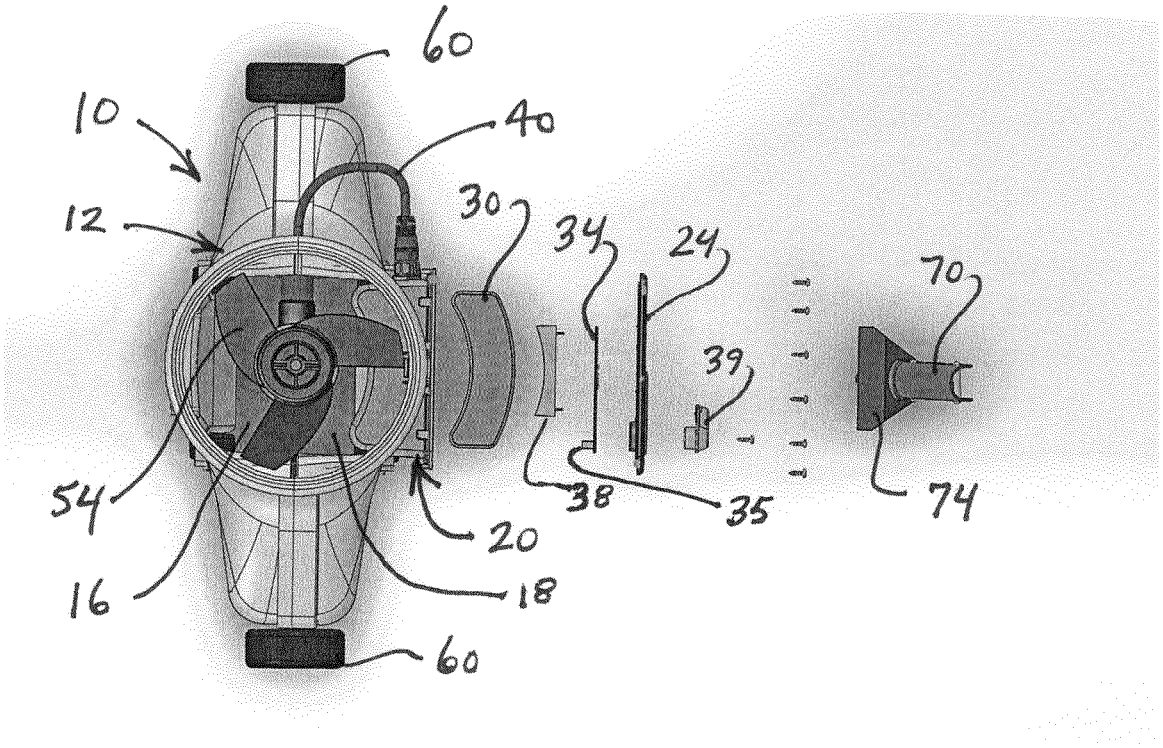
FIG. 6 is an exploded top plan view of the swimming pool vacuum and showing the onboard circuitry and battery power source that are received within the watertight compartment on the exterior of the vacuum head housing.

As seen in FIGS. 3-4 and 6, a propeller 54 is fixed to the motor shaft and is driven by the motor 50. The motor 50 and propeller 54 are maintained within the interior of the vacuum head housing 12, within a thrust channel 18 defined between the open bottom end 14 and the open top end 16. The motor 50 drives the propeller 54 to create a thrust through the vacuum head housing 12 from the open bottom end, defining a vacuum mouth, and up through the thrust channel 18 and out from the open top end, defining a top discharge opening. A catch bag (not shown) is removably secured to the top discharge opening 16 for collecting debris that is sucked through the vacuum mouth at the open bottom end 14 of the vacuum head.

Figure 5:
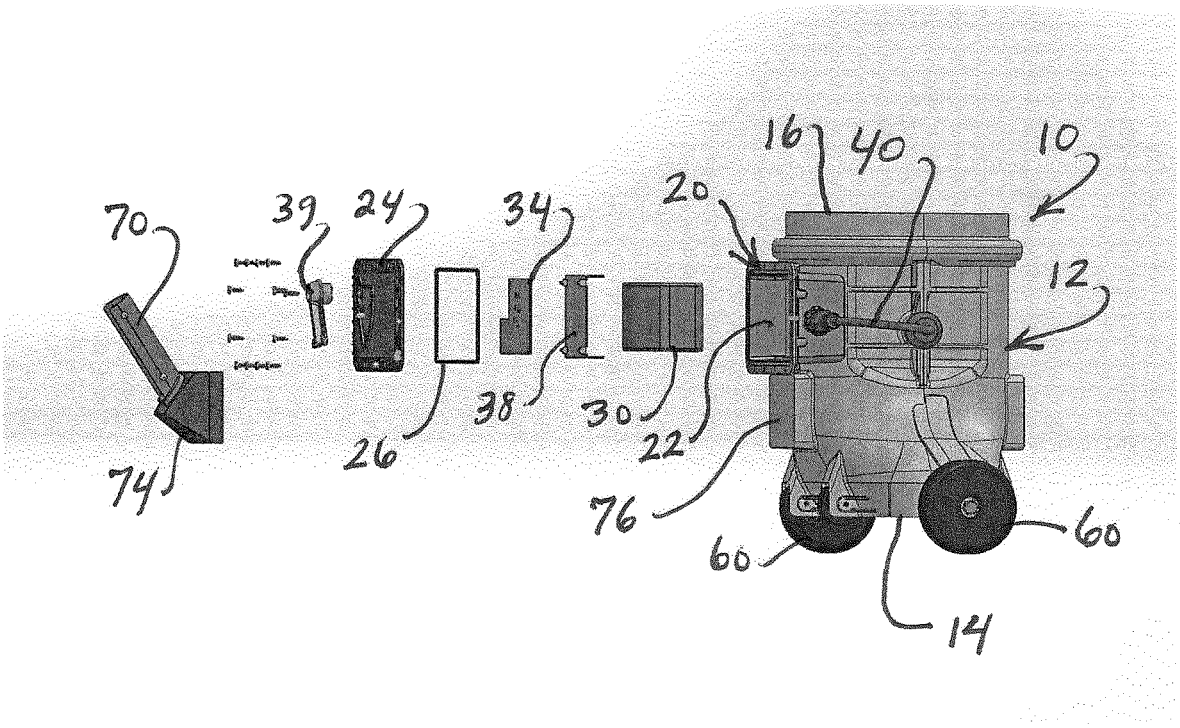
FIG. 5 is an exploded rear perspective view showing the swimming pool vacuum head, an onboard power supply and smart switch and a watertight compartment with a watertight cover for protectively containing the onboard power supply and smart switch circuitry.
Figure 7:
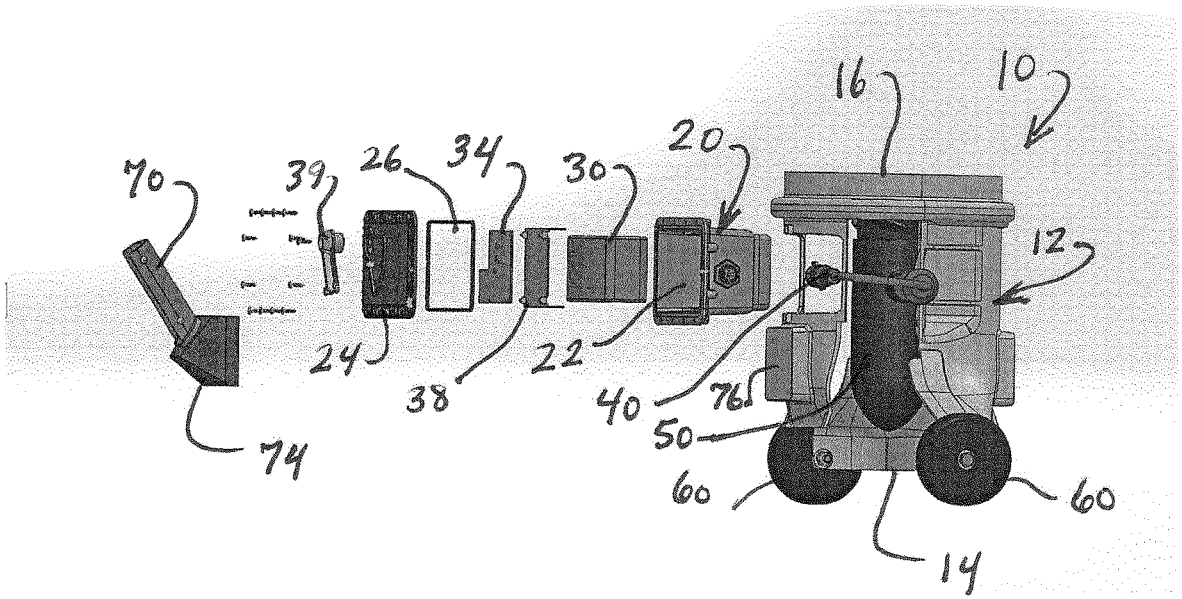
FIG. 7 is an exploded rear perspective view of the swimming pool vacuum showing the onboard power supply and smart switch that are received within the watertight housing, and the vacuum head and motor within the thrust channel of the vacuum head.

As seen in FIGS. 5-7, onboard circuitry 34 is contained within the watertight circuitry housing 20 on an exterior of the vacuum head housing 12, along with the rechargeable battery power supply 30. In a preferred embodiment, the battery power supply is a lithium ion rechargeable battery. A control switch lever 39 on the back cover 24 of the watertight housing 20 allows for changing the speed of rotation of the motor shaft and propeller by the operator. Additionally, the smart power switch 35 and control circuitry is able to detect an obstruction within the thrust channel that is interfering with rotation of the propeller 54. Upon detection of an obstruction, the smart power switch and control circuitry automatically reverses the direction of rotation of the motor shaft and propeller in an attempt to clear the obstruction. When the smart power switch and control circuitry detects that the obstruction has been cleared and is no longer interfering with rotation of the propeller, the control circuitry switches the rotation of the motor shaft and propeller back to the normal operational rotation direction and speed.

The vacuum head includes wheels 60 on the bottom of the vacuum head housing 12 to promote ease of movement and turning of the vacuum head along bottom surfaces of a swimming pool, while maintaining the vacuum mouth 14 at a desired distance of separation from the surfaces of the swimming pool.

A yoke 70 with a yoke block 74 fixedly attaches to a yoke mount platform 76 on a rear of the vacuum head housing. The yoke 70 is angled upwardly from the yoke block 74 and includes spring loaded pins or buttons 72 for moveable attachment to the end of a pole to allow an operator to move and manipulate the vacuum head 10 along the bottom surfaces of a swimming pool while standing on the deck surrounding the swimming pool.

While the present invention has been shown and described in accordance with a preferred and practical embodiment, it is recognized that departures from the instant disclosure are fully contemplated within the spirit and scope of the invention.

What is claimed is:

1. A swimming pool vacuum comprising:

a vacuum head including a housing with an elongate vacuum mouth at a bottom end, a discharge opening at an opposite end and a thrust channel extending there between and in fluid flow communication with the elongate vacuum mouth and the discharge opening;

an electrically powered motor supported in fixed position with the thrust channel and including a motor shaft at a top end that is rotated by the motor;

a propeller fixed to the motor shaft and structured and disposed to rotate with the motor shaft upon driven rotation by the motor to create a force of thrust through the vacuum head housing from the elongate vacuum mouth through the thrust channel and out from the discharge opening;

an onboard power supply for supplying electric power to operate the motor;

a circuit board containing control circuitry including a smart power switch for controlling operation of the motor to rotate the motor shaft at different speeds and for reversing the direction of rotation of the motor shaft and propeller;

a watertight housing mounted to the vacuum head housing and including at least one interior watertight compartment for containing the onboard power supply and the circuit board; and a watertight electrical power supply connection mechanism between the onboard power supply and the motor and including a watertight passage through the watertight housing.

2. The swimming pool vacuum as recited in claim 1 wherein the onboard power supply is a rechargeable battery.

3. The swimming pool vacuum as recited in claim 2 wherein the rechargeable battery is a lithium ion battery.

4. The swimming pool vacuum as recited in claim 1 wherein the smart power switch and control circuitry are structured and disposed for detecting an obstruction to rotation of the propeller and for reversing direction of driven rotation of the motor shaft and propeller by the motor to remove the obstruction.

* * * * *